US005771675A

United States Patent [19]

Rader et al.

[11] Patent Number: 5,771,675

[45] Date of Patent: Jun. 30, 1998

[54] PROCESS AND DEVICE FOR ALTERNATELY GIVING A YARN AN "S" TWIST OR A "Z" TWIST

[75] Inventors: Wolfgang Rader, Schonungen; Gunther Schmitt, Hammelburg, both of Germany

[73] Assignee: Temco Textilmaschinenkomponenten GmbH & Co. KG, Hammbelburg, Germany

[21] Appl. No.: 682,686

[22] PCT Filed: Jan. 17, 1995

[86] PCT No.: PCT/EP95/00158

§ 371 Date: Oct. 18, 1996

§ 102(e) Date: Oct. 18, 1996

[87] PCT Pub. No.: WO95/19460

PCT Pub. Date: Jul. 20, 1995

[30] Foreign Application Priority Data

Jan. 18, 1994 [DE] Germany ..... 44 01 321.3

[51] Int. Cl.[6] ..... D01H 1/11

[52] U.S. Cl. ..... 57/339

[58] Field of Search ..... 57/338, 339, 340

[56] References Cited

U.S. PATENT DOCUMENTS

| | | | |
|---|---|---|---|
| 4,047,374 | 9/1977 | Venot | 57/338 |
| 4,704,858 | 11/1987 | Naylor et al. | 57/339 X |
| 5,099,642 | 3/1992 | Rader et al. | 57/338 X |
| 5,255,503 | 10/1993 | Rader et al. | 57/339 X |
| 5,349,808 | 9/1994 | Lorenz | 57/338 X |
| 5,414,989 | 5/1995 | Rader et al. | 57/339 |

FOREIGN PATENT DOCUMENTS

| | | | |
|---|---|---|---|
| 2655662 | 6/1991 | France . | |
| 2310802B2 | 5/1979 | Germany . | |
| 2943279 | 5/1981 | Germany . | |
| 3123753 | 2/1982 | Germany | 57/340 |
| 4115629A1 | 11/1992 | Germany . | |
| 2078794 | 1/1982 | United Kingdom . | |
| 2239267 | 6/1991 | United Kingdom . | |

*Primary Examiner*—Daniel P. Stodola
*Assistant Examiner*—Tina R. Taylor
*Attorney, Agent, or Firm*—Pandiscio & Pandiscio

[57] ABSTRACT

A device for false-twist texturing of yarn material includes at least three rotatable twisters for disposition around a yarn texturing center, "S"/"Z" twist changeover apparatus for adjusting positions of two of the twisters in relation to a first of the twisters and to transpose the two twisters with each other, and drive changeover apparatus for reversing the rotative drive direction of all of the twisters.

13 Claims, 9 Drawing Sheets

"Z"

PROCESS AND DEVICE FOR ALTERNATELY GIVING A YARN AN "S" TWIST OR A "Z" TWIST

Figure 1:
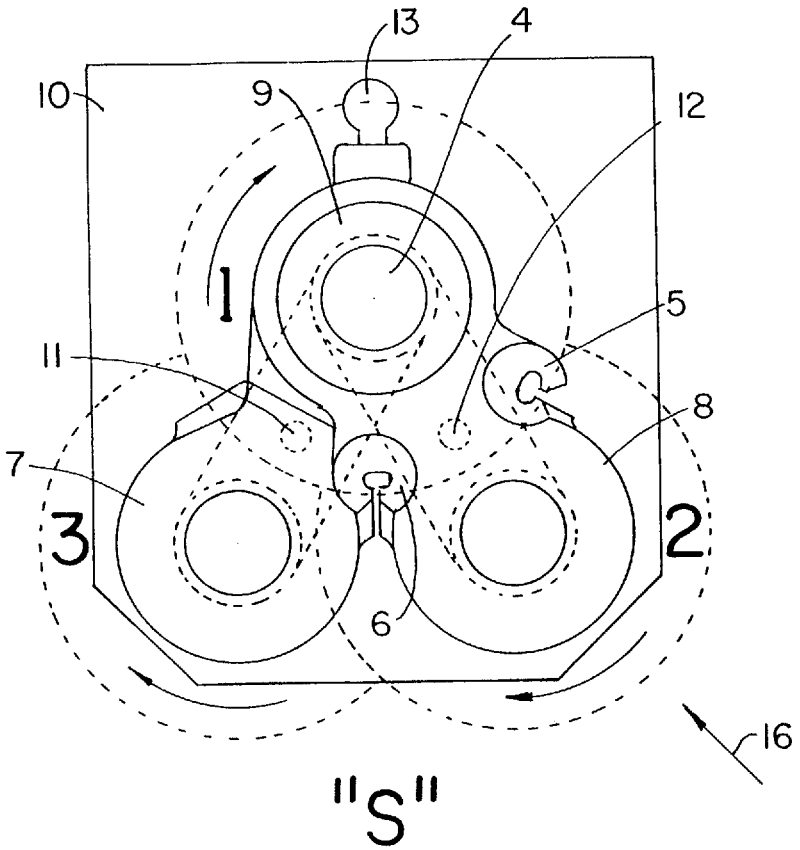

The invention concerns a process for alternately giving a yarn an "S" twist or a "Z" twist. The invention further concerns a device for false-twist texturing by means of a plurality of twisters driven in the same direction to exert a common effect on a yarn passing through them, which device can also be adapted to perform the aforesaid process.

The problem of changing a friction false-twist system from the "S"- to the "Z"-twist direction has been debated for many years and discussed in many published works, but no solutions that are easy to operate satisfactorily, uncomplicated in design and inexpensive to manufacture have become known. Much of the literature proceeds on the assumption that the friction disks have to assume a set position in the system. To accomplish this, friction disks are removed from the particular bearing and reinstalled in another position. During this operation, care must be taken to ensure that the disks in these mutually overlapping sets of friction disks are still in a set order even after the twist direction has been changed from "S" to "Z".

This problem was addressed in German Patent Application (Examined) 23 10 802, according to which the yarn follows a helical path as it passes from one friction surface to the next. Care must be taken in this context to ensure that the direction of this helical path, seen in the direction of travel of the yarn, is the same as the direction of movement of the friction disks or friction surfaces when they are in contact with the yarn. To produce an "S" twist, the direction of the helical path and the direction of travel of the friction surfaces must be the opposite of those needed to produce a "Z" twist. To achieve this, the aforesaid reference proposes, as a first approach, to reverse the direction of rotation of the friction disks and to convey one of the three sets of friction disks out of its position on the one side of the other two sets of friction disks into a corresponding position on the other side of the other two sets of friction disks, with the sequence in which the yarn comes into contact with the friction disks remaining the same. Alternatively, the aforesaid reference proposes to provide two separate groups of sets of friction disks, each in the form of a "plug-in," i.e., all the necessary disks are creeled on and fastened to a sleeve. To effect the changeover between "S" and "Z" twist, all the sets of friction disks must, of course, be lifted out of a receptacle simultaneously, since otherwise they would not be released from their overlap. Toothed belts and the like also must be removed before the changeover, so that it is impossible to effect a changeover on the machine, resulting in very long downtimes and consequent loss of production.

In a known false-twist device of the same species (German Patent Application 29 43 279 C2), changeover capability is obtained in that the right and/or left sets of disks can be swung out on two pivots to release the overlap, so that all three sets of disks are free. Individual disks, and especially the two sets of friction disks that have been swung out, can then be transposed. This realization does make it necessary first to remove the entire unit from the machine as a whole, since for reasons of space economization the spindle gauge is small. However, for the individual sets of friction disks to be swung out of their overlapped position, each set has to be driven by an individual motor that pivots with the set. If toothed belts are used as the drive coupling between the sets, these belts must be removed before the sets are swung out.

The task on which the invention is based therefore is, in a process or in devices of the same species free of the aforesaid disadvantages, to effect the changeover between "S" and "Z" twist in as simple a manner as possible without the need for costly and time-consuming mounting of textile machine components such as, for example, disk sets or drive parts. At the same time, the yarn production quality obtained after the changeover to "S" or "Z" twist should remain the same for both types of twist. The concept according to the invention that the "S"/"Z" changeover movements of one or more twisters are always related to a further twister assumed to be stationary with respect to the aforesaid twisters provides, inter alia, the structural advantage that the individual twisters can be flexibly interconnected to form an aggregate unit and this aggregate unit can be changed or flipped over between "S" and "Z" twist without the need to detach individual sets of disks from each other.

A special realization of the device according to the invention proceeds from bipartition, i.e., from a seat that can be movably installed on the textile machine and in which the aggregate twister unit, which, in the sense of the invention, is so realized that it can be handled and transported as a unit, including bearings, disk sets, mounting elements and drive elements, can be inserted as a unit. Especially in the realization of the flexible interconnection of the twisters by the swivel elements, this unit can be so implemented that the rotational axle of the rear or center twister, for example, constitutes the swivel axis of a swivel element of each of the additional left and right twisters. In the changeover from "S" to "Z" twist, for example, the unit is removed from the seat. A locking mechanism, inserted between the swivel elements and the seat, for example, is then triggered to unlock, after which the swivel elements can be swiveled. The swivel element carrying the left twister is swiveled clockwise about the rotational axle of the rear or center twister into the former position of the right twister. Simultaneously, the right twister is swiveled clockwise into the previous position of the former left twister. Defined positioning and subsequent locking of this changeover can be added by the incorporation of potential latching elements and complementary stop notches between the swiveling mountings and the seat. The unit is then reinserted into the seat.

In a particular realization of the invention, the seat is equipped with different insertion positions such that the drive coupling of the twisters is effected by means of a drive mechanism in a clockwise or a counterclockwise direction, depending on whether the setting is for "S" or "Z" twist. In the changeover from "Z" to "S" twist, the said manipulation step is performed in a similar manner, but counterclockwise. The changeover can be made directly at the spindle station, without the need for any costly mounting devices or tools.

According to a realization of the invention, each swivel element is provided with one or more thread-guide devices and/or thread-guide conduits. The advantage gained thereby is that the thread guide for "S" or "Z" twist moves rigidly with the swivel element and thus can be moved into the prescribed "S" or "Z" position automatically.

In many texturing machines the numerous individual twister units are coupled to a common drive, for example a tangential friction belt. To effect the changeover from "S" to "Z" twist with only one twister unit, ready decoupling from the drive source is desirable. To solve this problem, a special realization of the invention provides that the seat be mounted on a holding device on the textile machine via a bearing that permits linear displacement and/or rotation. The linear offset or the rotation is then used to effect the coupling and/or decoupling in the desired direction of drive for "S" or "Z" twist. This realization is especially advantageous in the case of drive coupling via one or more whorls of a twister unit which are in frictional contact with a continuous tangential friction belt serving as a common drive source. If the unit has only one drive whorl, the drive coupling can advantageously be effected via a linear (lateral) offset of the seat, together with the unit, to bring about the contact between the whorl and the tangential friction belt. In a unit with two drive whorls on different twisters, it is advantageous to rotate the seat of the unit. In this case, a realization of the invention provides for interaction with a counterpressure roller which is also mounted in the seat and can be adjusted along with it. Ease and/or convenience of operation is increased if, according to a further realization of the invention, a stationary, automatically or manually operated adjusting mechanism is provided, supported, for example, against the frame of a texturing machine, and acting on the seat, causing it to move. In this arrangement, the seat, along with the twister unit it contains, can be offset or rotated via the bearing by which it is mounted on the textile machine in such a way that, for example, the drive whorl or whorls can be made to engage with or disengage from a tangential friction belt.

One requirement in the practical operation of texturing machines is that the rotation of the twister, i.e., its coupling with the drive mechanism, must be maintained while the yarn is being threaded into the texturing center inside the twister. For this purpose there are known threading mechanisms (see German Patent Application [Unexamined] 41 15 629A1) that comprise a swivelable threading lever extending to the texturing center against a relatively soft spring, and a locking lever which swivels after a time lag via a relatively hard spring and which, when closed with the threading lever, can be made to engage therewith, securing it. According to an improvement, such threading aids can advantageously be combined with the device according to the invention equipped with swivel elements, the threading and locking levers each being disposed on a respective swivel element and at least the threading lever being mounted so that it is able to swivel with respect to the swivel element. The locking lever, in contrast, can be mounted immovably on the swivel element assigned to it, and in particular, can be implemented as integral to the said swivel element.

Figure 2:
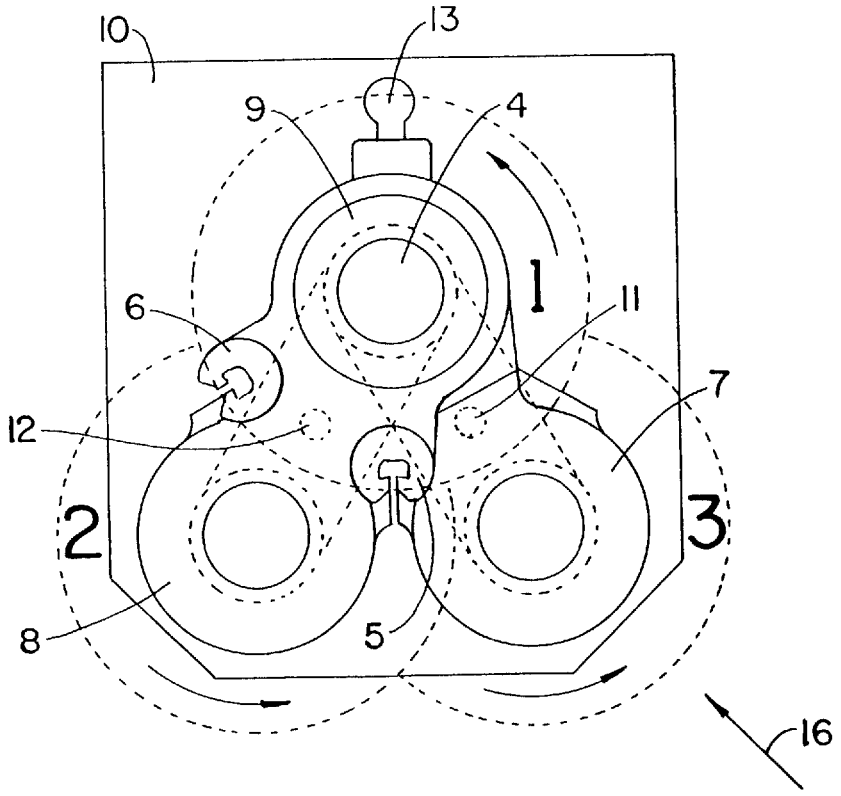
Figure 3:
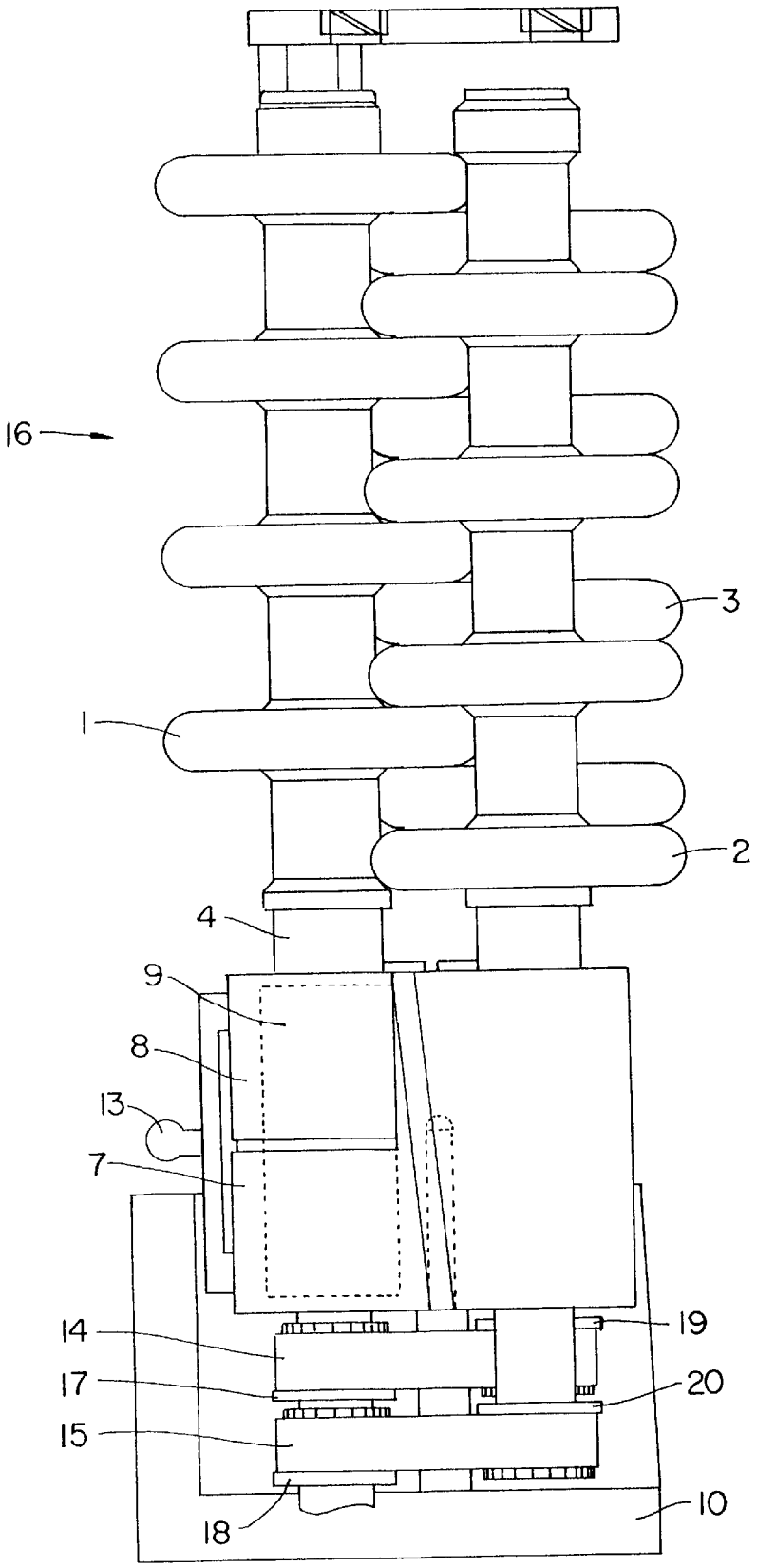
Figures 4A, 4B:
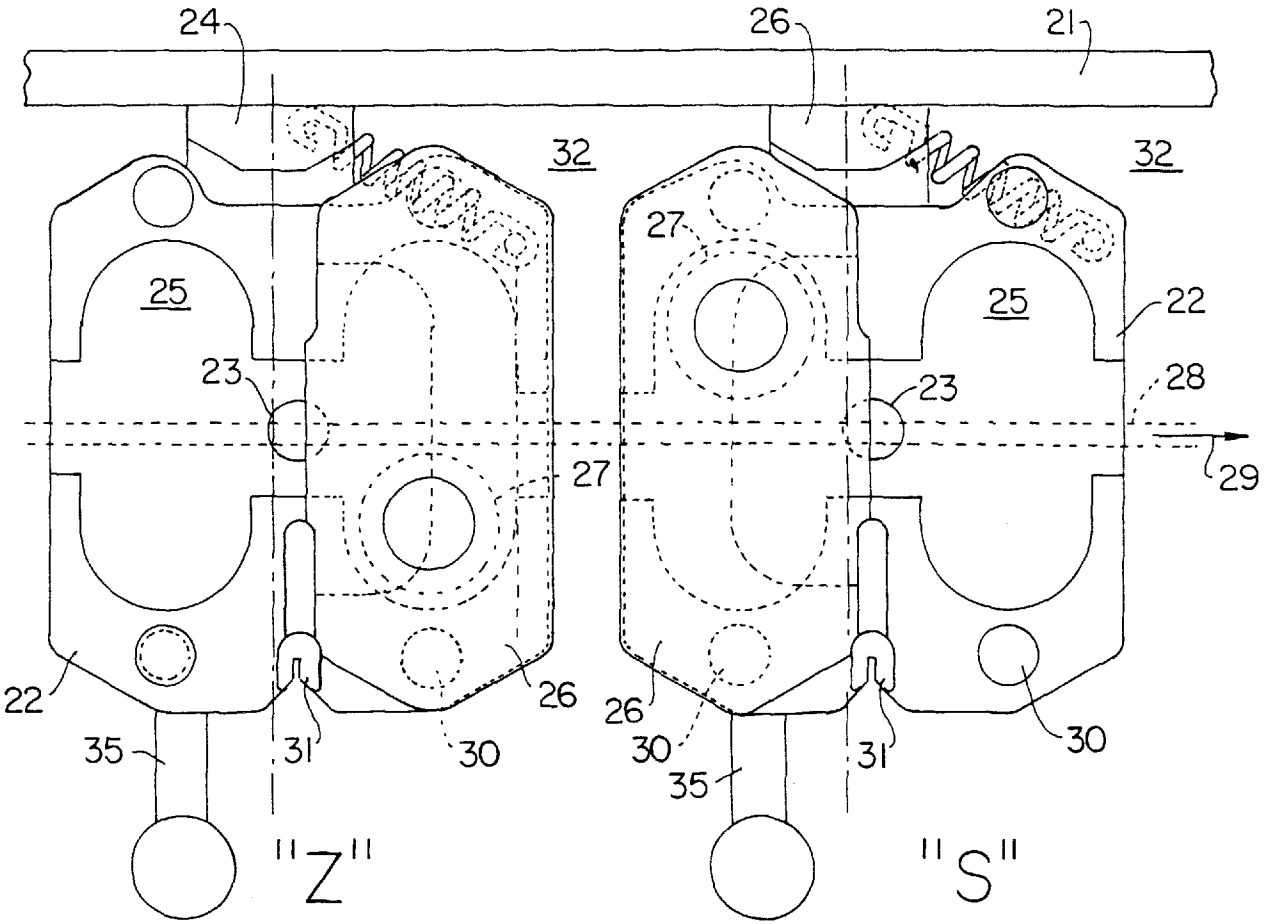
Figures 5A, 5B:
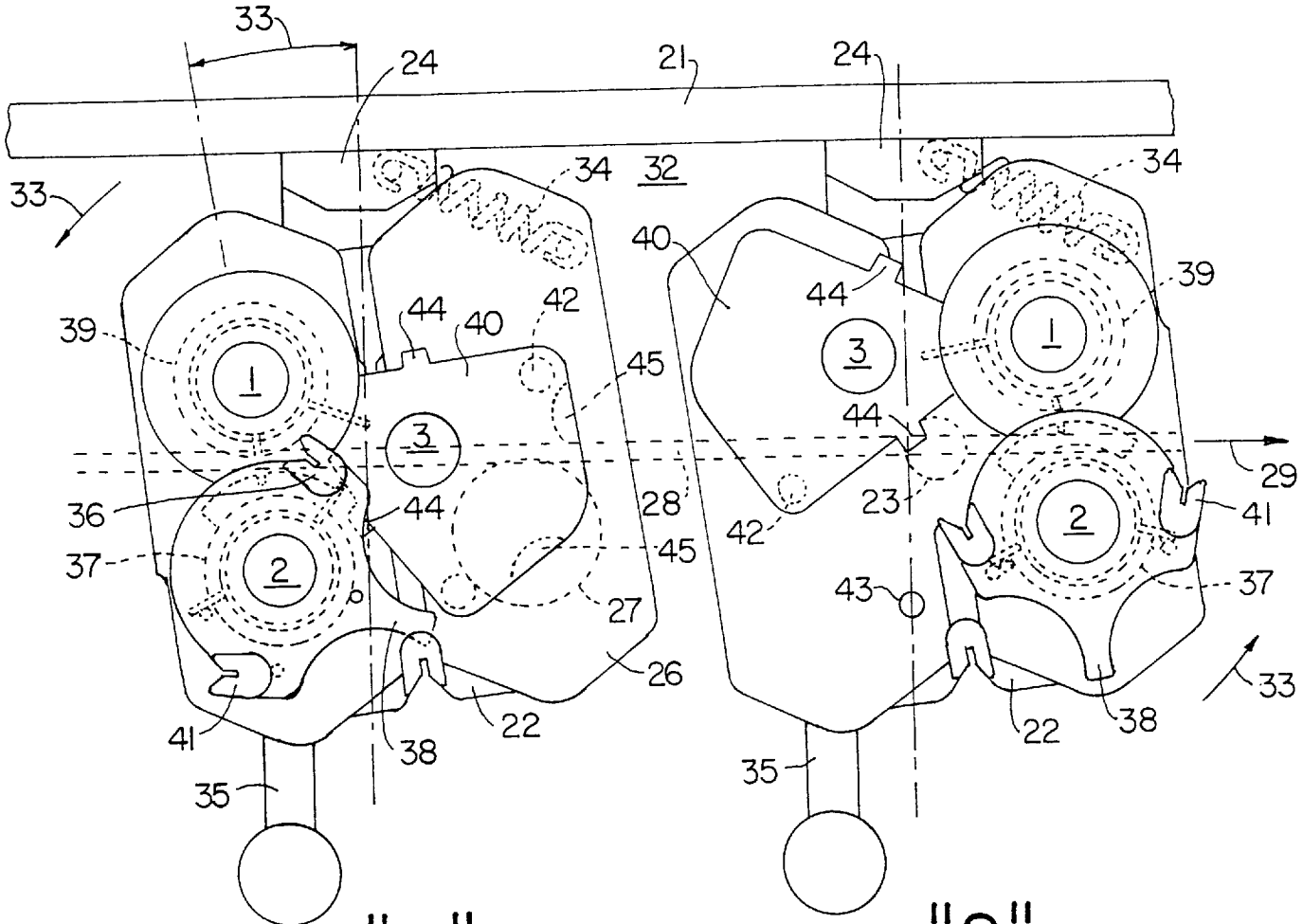
Figures 6A, 6B:
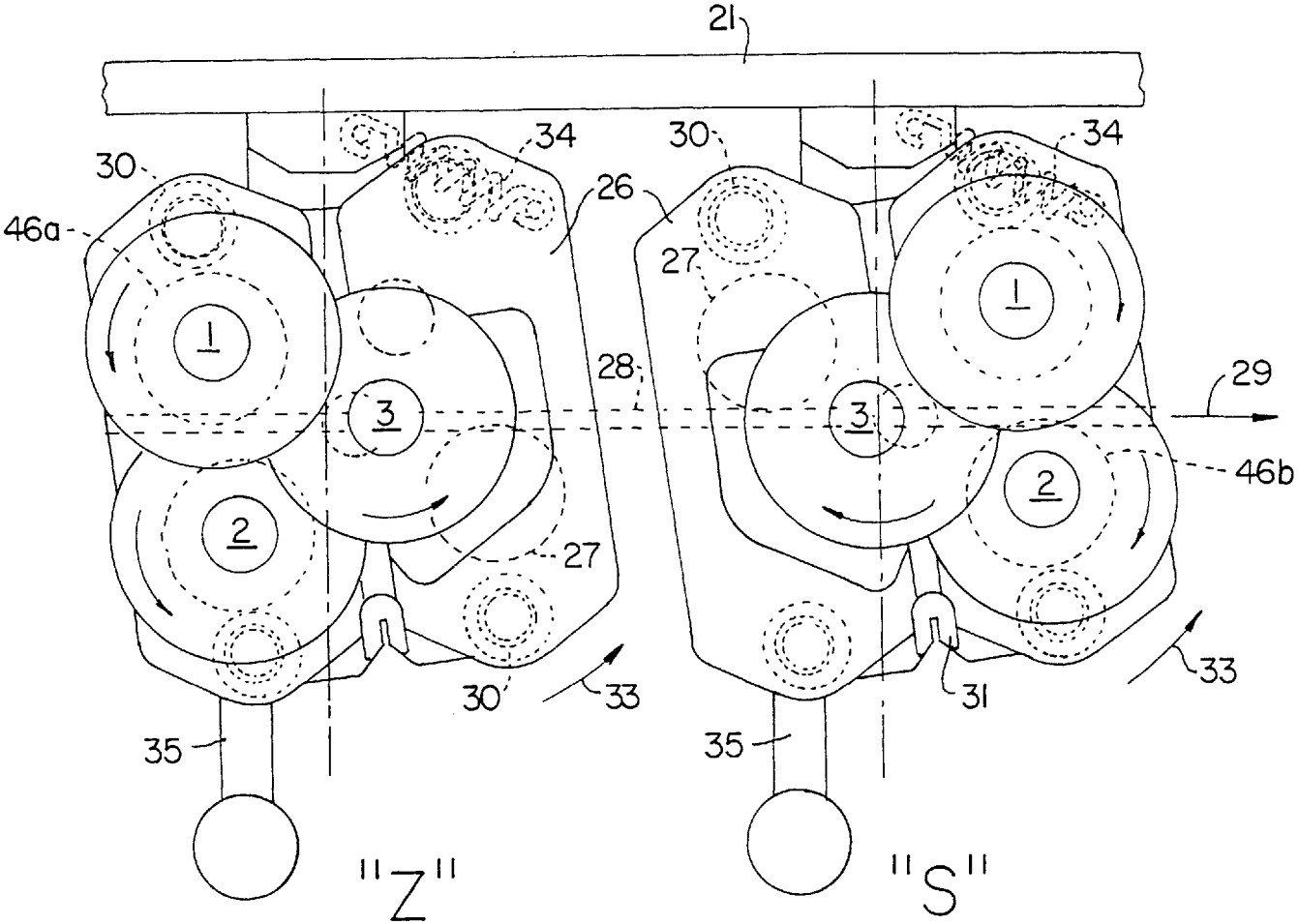
Figure 7A:
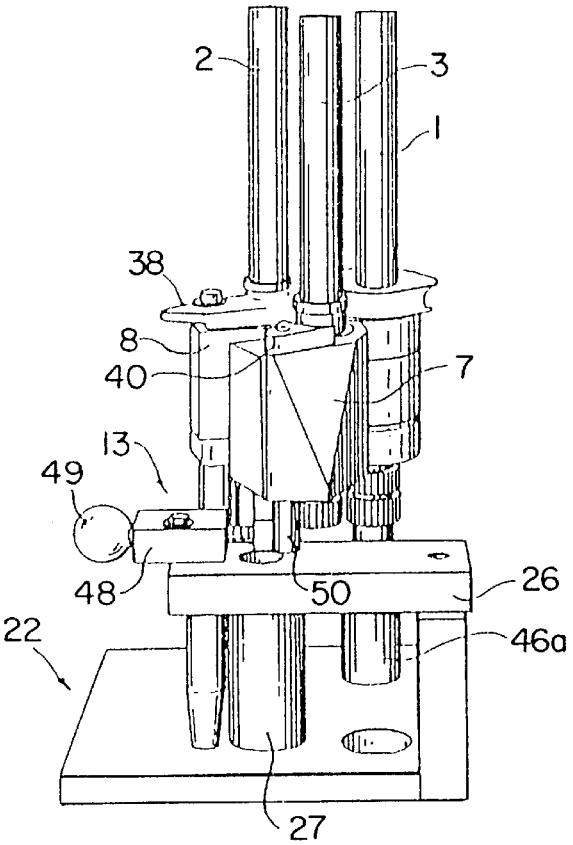
Figure 7B:
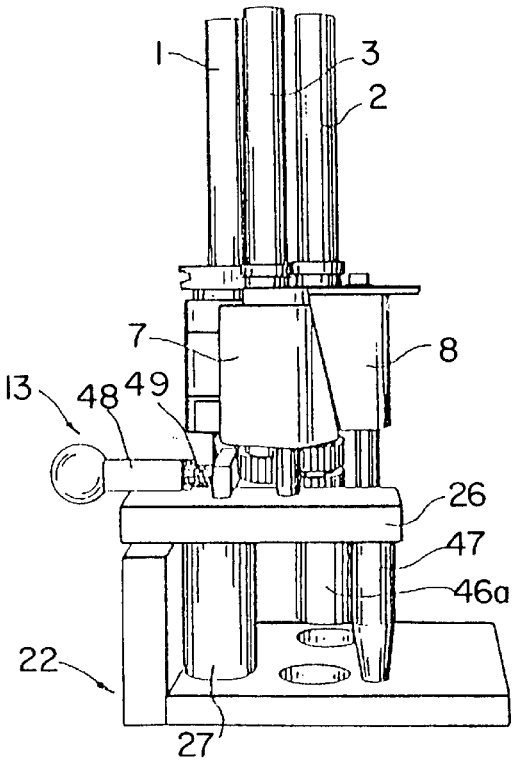
Figure 8:
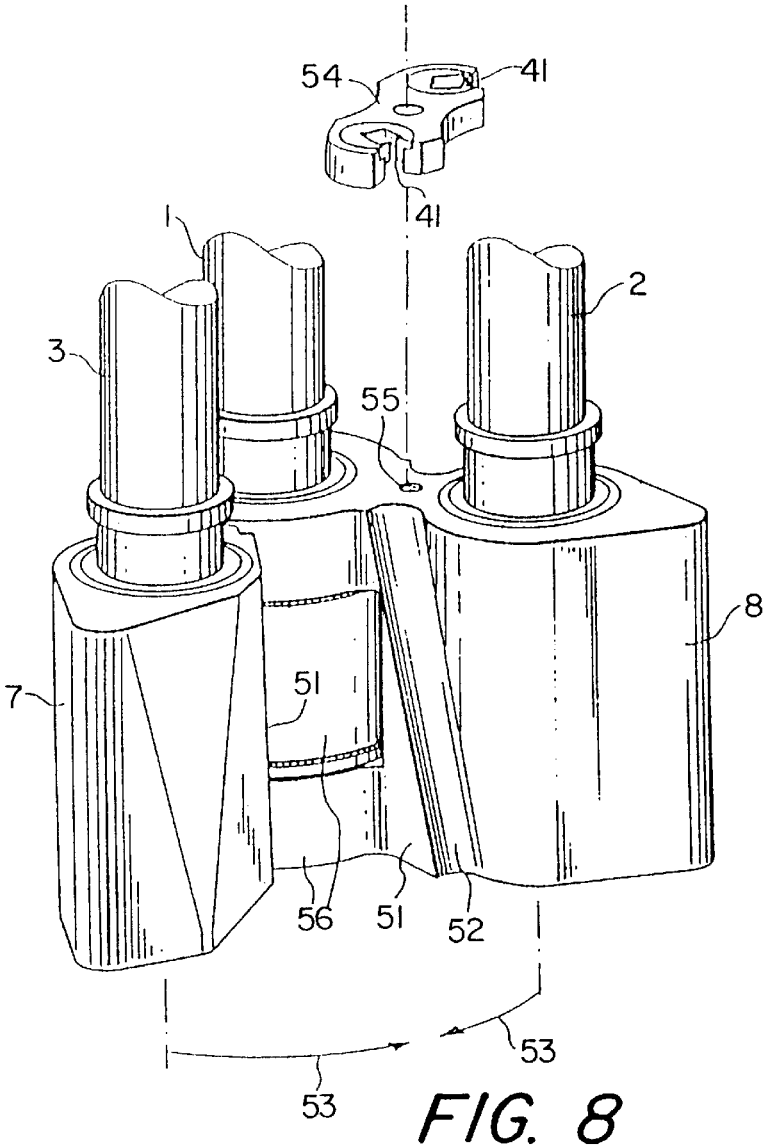
Figure 10:
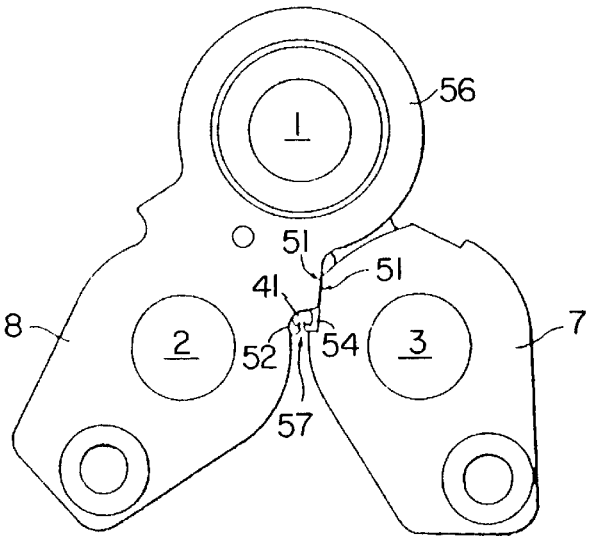
Figure 9:
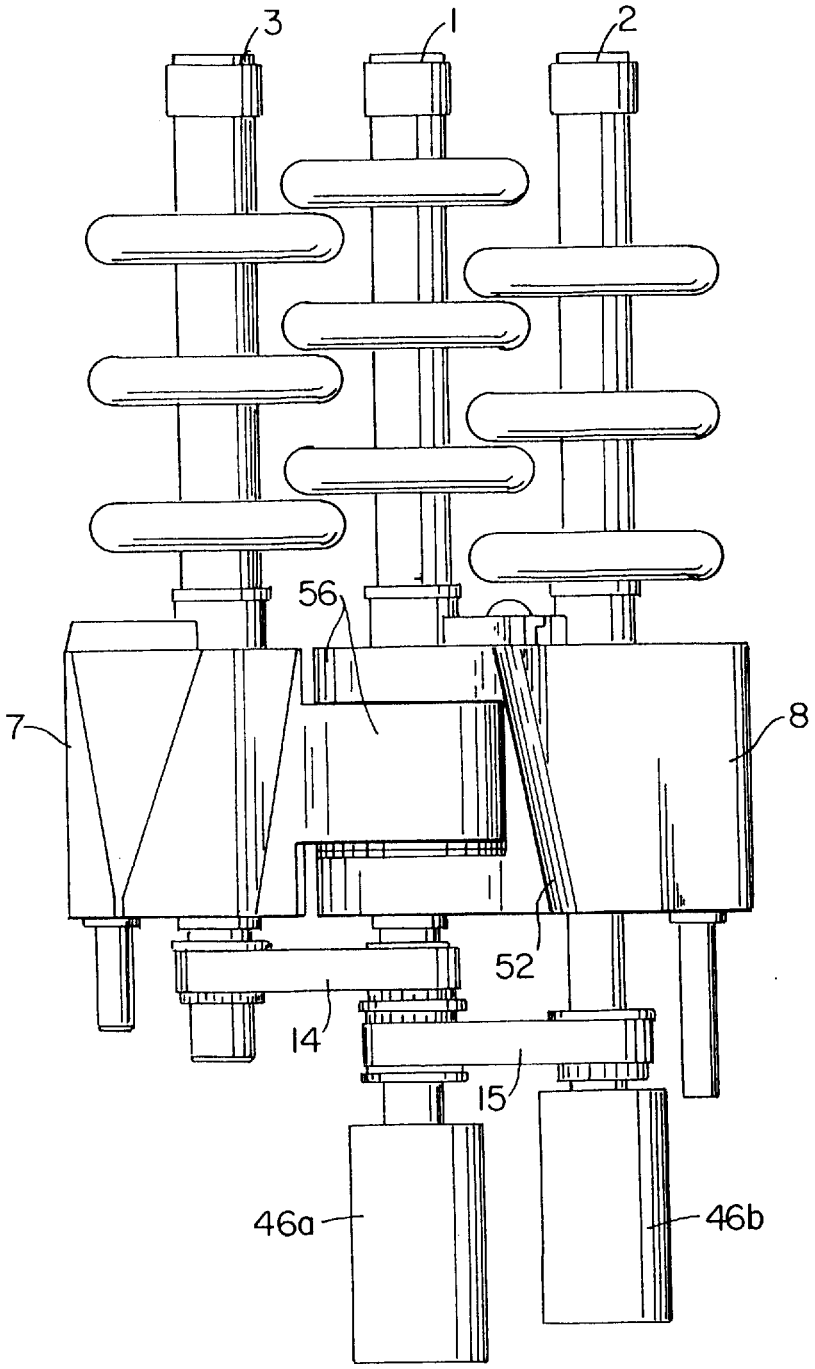

Further details, features and advantages based on the invention will emerge from the dependent subclaims and from the following description of preferred embodiments of the invention, provided with reference to the drawings, which show:

FIG. 1 in plan view, a false-twist unit with friction disks in the "S" twist position, FIG. 2 in plan view, the false-twist unit in the "Z" position, FIG. 3 a side elevation of the false-twist unit according to FIGS. 1 and 2, FIGS. 4*a* in plan view, the seat according to the invention with and 4*b* a counter-roller mounting for the "Z" or "S" position with the twister unit removed, FIGS. 5*a* and 5*b* in plan view, the false-twist unit according to the invention with the threading mechanism actuated in the closed "Z" or open "S" position, FIGS. 6*a* and 6*b* in plan view, the false-twist unit according to the invention with rotating twisters in the "Z" or "S" position, FIGS. 7*a* and 7*b* in diagrammatical side elevation, an exemplary device according to the invention in the "Z" or "S" position, FIG. 8 in perspective view, the swivel elements of the twister unit with stop faces facing each other, FIG. 9 in longitudinal view, a twister unit according to the invention in the state after it has just been flipped open, FIG. 10 a front view in the axial direction of the twister unit according to FIG. 8 or FIG. 9.

According to FIG. 1, a centrally disposed twister 1, for example a set of multiple coaxial friction disks, is seated in a bearing bed 9. The rotational axle 4 thereof simultaneously constitutes the swivel axis of swivel element 7, which carries left twister 3, and swiveling holder 8 with right twister 2. A thread guide 6 with an open eye shape is integrated into swiveling holder 7 in such a way that it is able to act on the yarn passing between the two swiveling holders in the texturing center of the unit when it is in the "S"-twist position. A further thread guide 5 is fastened to the other swiveling holder 8 in the vicinity of the center twister 1 in such a way that it is idle in the "S" position according to FIG. 1. Via latch and stop-notch elements 11, 12, swiveling holders 7, 8 can be locked in set positions according to the "S" or "Z" position. Further provided is a locking mechanism 13 which can be realized, for example, as a peg that can be displaced against spring pressure by means of a handle, whereby swiveling holders 7, 8 can be fixed and secured in their positions with respect to bearing bed 9. The complete unit 16, comprising twisters, swiveling holders and bearing bed, can be inserted in a seat 10 that can be fastened to a stationary machine foundation.

FIG. 2 depicts the structure for "Z"-twist operation described with reference to FIG. 1. To effect the changeover to "Z" twist, a movement capability for the swiveling holders 7, 8 consists in guiding each of the swiveling holders counterclockwise in a circular path around center twister 1 into the position of the respective other swiveling holder 8 or 7. Here again, the components can be secured via latch and stop-notch elements 11, 12. A locking mechanism 13 again serves to hold them together. The complete unit 16 is then placed in the seat 10 so that production can proceed.

According to FIG. 3, unit 16 is inserted in seat 10. The shaft ends of the twisters 1, 2, 3, which protrude axially from the swiveling holders, are each encircled by four toothed rollers 17, 18, 19, 20, the shaft end of the center twister 1 carrying two toothed rollers 17, 18 axially one behind the other. In the lateral depiction, swiveling holders 7, 8 obscure bearing bed 9 rotatably containing the twisters, including rotational axle 4 of center twister 1. Locking mechanism 13 halts swiveling holders 7, 8 with respect to bearing bed 9. Latch and stop-notch elements 11, 12 define the relative positions of twisters 1, 2, 3 with respect to each other for the "S" or "Z" position.

The following should be added in particular for the mode of operation of the friction false-twist system according to FIGS. 1–3: According to FIGS. 1 and 2, the twist direction can be changed to produce "S" or "Z" twist, the friction disks rotating in the same direction and, in an "S" to "Z" changeover, the positions of at least the right and left twisters 2, 3 being transposed. Here the center axle or rotational axle 4 of center twister 1 constitutes the swiveling axis, so that, for example in "Z" rotation, the left twister 3 is swiveled clockwise to the position of the right twister 2. Simultaneously, right twister 2 is also moved around rotational axle 4 of center twister 1 into the position of the former left twister 3. The changeover to "S" twist takes place in a similar manner in the opposite direction. To ensure that one thread guide 5, 6 is always operative in "S"- or "Z"-twist mode, in the exemplary embodiment according to FIGS. 1–3 the thread guide 6 for "S" rotation on swiveling holder 7 of the left twister according to FIG. 1 and the thread guide 5 for "Z" rotation on the swiveling holder 8 of the right twister 2 according to FIG. 1 are rigidly attached. In this way, in an "S"/"Z" changeover each thread guide moves to its prescribed position in the texturing center.

In the "S"/"Z" changeover according to FIGS. 1–3, it must be possible to remove unit 16, comprising, for example, swiveling holders 7, 8, each on one of outer twisters 3, 2, bearing bed 9 with outer twisters 3, 2, and/or center twister 1 with its rotational axle 4, thread guides 5, 6, etc., from seat 10 and reinsert it after outer twisters 2, 3 have been moved around center twister 1. Proceeding outward from bearing bed 9, swiveling holders 7, 8 can be released or locked via locking mechanism 13. A particular advantage is that during the changeover of the unit from "S" to "Z" , toothed belts 14, 15, which are necessary -for further operation and which are engaged with toothed rollers 17, 18, 19, 20, can remain in place.

According to FIGS. 4*a* and 4*b*, different texturing stations in the "Z"- and "S"-twist positions are attached to a common fastening rail 21 of a texturing machine, not depicted in further detail. Each station is based on a frame-like receiving support 22, which is seated rotatably, via a pivot bearing 23, on a machine holding device 24 that protrudes from fastening rail 21. Two receiving recesses 25 are implemented as halves inside the frame-like structure of the receiving support 22. Inserted in each of these receiving recesses is a mounting 26, of an elongated plate-like shape, for example, which carries on its bottom face a rotatably mounted counter-roller 27 designed to press against a tangential belt 28 which passes through receiving supports 22 in direction of movement 29. The frame of receiving support 22, which surrounds receiving recesses 25, is further provided in each half with insertion bores 30 and a thread-guiding eye 31 centrally disposed on its outer edge. Counter-roller 27, which is disposed in one longitudinal half of counter-roller mounting 26, is, when in the "Z" position according to FIG. 4*a* requiring clockwise rotation, outside the intermediate space 32 for counterclockwise rotation bounded by tangential friction belt 28 and fastening rail 21, and inside it when in the "S" position according to FIG. 4*b*.

To force counter-roller 27 against tangential friction belt 28, receiving support 22 according to FIG. 5*a* must be given a rotation 33 within the range of an acute angle on its pivot bearing 23. This is accomplished by means of a manually actuated contact member comprising a release lever 35 and a draw spring 34 suspended from mounting 26 and receiving support 22. The Release lever can be swung vertically to the plane of drawing against the pressure of a leaf spring (not shown), whereupon a catch mounted on the leaf spring engages or does not engage the outer edge of the receiving support, depending on the swiveled position. When engagement occurs, according to FIGS. 4*a* and 4*b*, counter-roller 27 is not in contact with tangential friction belt 28, and when engagement does not occur, according to FIGS. 5*a*, 5*b*, 6*a*, 6*b*, counter-roller 27 is in contact with tangential friction belt 29. In the position where contact with friction belt 28 is not present, according to 4*a* and 4*b*, the load on draw spring 34 is increased, and in the contact position according to FIGS. 5*a*–6*b*, the load is decreased or nonexistent.

According to FIG. 5*a* and 5*b*, the device according to the invention is provided with a threading mechanism comprising a threading lever 38 that can be swung over to the texturing center 36 against the pressure of a relatively soft torsion spring 37, and a locking lever 40 that can be swung over to the texturing center 36 against the pressure of a relatively hard torsion spring 39. Threading lever 38 is provided, on the circumference of its pivot bearing, with two nearly diametrically opposite, open threading eyes 41, one of which overlaps with texturing center 36 in closed position, for example according to FIG. 5*a*. In the open, pushed-apart position according to FIG. 5*b*, a thread or yarn (not shown) can be caught therein and guided to the texturing center by swinging threading lever 38 over to the texturing center with a finger of the hand. If the thumb, for example of the same hand, is applied to locking lever 40, due to its harder spring 39 said locking lever requires higher torque in order to be swung over to the texturing center. As a result, when the threading mechanism is operated manually, threading lever 38, with any yarn present in threading eye 41, is first moved inwardly toward texturing center 36 and is followed after a time lag by locking lever 40. A locking boss 42 realized on locking lever 40 can, as the said lever is swung farther, mate with a complementary snap-in indentation 43, while simultaneously one of two symmetrically disposed stop lugs 44 engages with threading lever 38 and holds it in texturing center 36 together with one of its symmetrically disposed threading eyes 41, as according to FIG. 5*a*. This halted position of locking lever 40 is secured by means of snap closure 42, 43. To facilitate the manual operation of locking lever 40, the latter can be provided on its outer edge with spheroidal recesses 45, also arranged symmetrically for both the "S" and the "Z" position, to facilitate manual operation with the fingers and thumb. The symmetrical arrangement of the two or bilateral threading eyes 41, locking bosses 42 plus complementary-indentations 43, stop lugs 44 and finger recesses 45 makes it possible to lock the twister unit 1, 2, 3 in both the "Z" and "S" positions. The swivel axis of threading lever 38 coincides with the rotational axle of twister 2, which is on the right in the "S" position, and the swivel axis of locking lever 40 coincides with rotational axle 4 of center twister 1. Further, the locking lever is rigidly connected to swiveling holder 7 carrying left twister 3, and thus serves to lock the entire twister unit 1, 2, 3 around rotational axle 4 of center twister 1, which in the depictions according to FIGS. 4*a*–6*b* is always behind or immediately adjacent to fastening rail 21.

The "Z" position according to FIG. 6*a* corresponds to that of FIG. 2, and the "S" position in FIG. 6*b* to that of FIG. 1. According to FIG. 6*a*, a drive whorl 46*a* of the center or rear twister 1 is in frictional contact with tangential friction belt 28, and according to FIG. 6*b*, a drive whorl 46*b* of right twister 2, which in "S"-twist position is opposite rear twister 1, is in frictional contact with the tangential friction belt. This drive coupling is effected by means of the acute-angled rotation 33, which is based on the actuation of the above-described contact member by means of draw spring 34 and release lever 35. In "Z"-twist position, mounting 26 with counter-pressure roller 27 is inserted in the right-hand one of the two receiving recesses 25 of receiving support 22 via insertion bores 30. Twister unit 1, 2, 3 is held via further insertion bores 30 in the other half of receiving support 22, with the result that counter-roller 27 presses tangential friction belt 28 against drive whorl 46*a* of center twister 1. To change over from "Z"-twist position to "S"-twist position according to FIG. 6*b*, the acute-angled rotation 33 is first made in reverse until release lever 35 flips up due to the pressure of the spring and holds the receiving support in the positions vertical to fastening rail 21 depicted in FIG. 4*a* and FIG. 4*b*. Unit 1, 2, 3 with twisters 2, 3 coupled to center twister 1 is then withdrawn from insertion bores 30 and receiving recess 25 in the left half of receiving support 22. To allow for the reversal of the twist direction for the "S" position, the sequence of the friction disks of twisters 2, 3, seen in the direction of travel of the yarn, must be maintained. In addition, as an alternative to having the coupled twisters 2, 3 move in the same direction as described with reference to FIGS. 1 and 2, the coupled twisters can be made to travel in mutually opposite directions and to stop after coming in contact with each other, until the rotational axles of all three twisters again form the corners of an equilateral triangle. According to a third movement alternative, only one of the two coupled twisters 2, 3 need orbit around center twister 1 from the stop face of the respective other coupled twister to its other, opposite stop face. The entire twister unit 1, 2, 3 is then so rotated that center twister 1 can again move, with respect to the twister 2, 3 coupled thereto, into the position adjacent to fastening rail 21. Twister unit 1, 2, 3 is then inserted in insertion bores 30 on the right half of receiving support 22 according to the drawing, after counter-roller mounting 26 has first been removed therefrom and inserted in the insertion bores 30 in the other half of receiving support 22. Since drive whorl 46*b* of the coupled right twister 2 now lies closely against the side of tangential friction belt 28 opposite fastening rail 21, the twist direction of twisters 1, 2, 3 is changed from counterclockwise according to FIG. 6*a* to clockwise according to FIG. 6*b*.

In FIGS. 7*a* and 7*b*, in which twisters 1, 2, 3 are depicted with the friction disks removed, receiving support 22 is essentially composed of two plates welded together at right angles, resulting in an L-shaped profile in side view. Projecting from the longer, horizontal plate of receiving support 22 are mounting pegs 47, via which counter-roller mounting 26 and twister unit 1, 2, 3 can be placed next to each other in either half of receiving support 22. Tangential belt 28 (not shown here) passes either between counter-roller 27 and drive whorl 46*a* of center twister 1, according to FIG. 7*a*, or, according to FIG. 7*b*, between counter-roller 27 and drive whorl 46*b* of right twister 2 according to FIG. 1.

According to FIG. 7*a* and 7*b*, the locking mechanism 13 is realized specifically as follows: A manually operable locking bolt 49 is guided against spring pressure in a plain bearing block 48 screwed onto counter-roller mounting 26. In the closed position according to FIGS. 5*a*, 6*a* and 6*b*, this locking bolt presses against a peg 50 projecting from the bottom of swiveling holder 7 with locking lever 40, thereby maintaining the twister unit in closed position. To open the twister unit, locking bolt 49 is pulled away from peg 50 against spring pressure, and locking lever 40 is pressed into the open position according to FIG. 5*b* by the spring assigned to it, together with swiveling holder 7 rigidly connected to it. Locking bolt 49 is depicted in the pulled-back position in FIG. 7*b*.

According to FIG. 8, swiveling holders 7, 8 are provided with stop faces 51 facing each other and beveled in such a way that upon contact the rotational axles of twisters 1, 2, 3 form the corners of an equilateral triangle. At least one of the opposite walls of the two swiveling holders 7, 8 is provided with a recessed channel 52 which, when stop faces 51 are flipped toward 53 and into contact with each other, produces a guide conduit 57 for the passage of the yarn. Further, in the realization according to FIG. 8, a thread-guide arrangement 54 can be contrived in a screw hole 55 only on swiveling holder 8 of the right twister and is realized symmetrically with threading eyes 41 on opposing sides for both the "S" and "Z" positions. The realization according to FIG. 9 differs from that of FIG. 8 essentially by the fact that the center twister 1 and the right twister 2 are each provided with a drive whorl 46*a*, 46*b*. In addition, the coupling of swiveling holders 7, 8 to the rotational axle of the center twister 1 via hinged joints 56 is visible, as it is in FIG. 8.

In the front view according to FIG. 10, the angularly bent thread-guide conduit 57 formed in connection with the groove 52 is clearly visible. Here the stop faces 51 from FIG. 8 are in contact with each other.

We claim:

1. A device for false-twist texturing, said device comprising:

at least three rotatable twisters for disposition polygonally around a yarn texturing center and driven in a same rotative direction to exert a common effect on a yarn passing through said twisters;

"S"/"Z" twist changeover means for adjusting width-wise positions of two of said twisters in relation to a first of said twisters and to transpose said two twisters with each other to effect a changeover between "S" and "Z" twists; and drive changeover means for reversing the rotative direction of all of said twisters;

said "S"/"Z" twist changeover means comprising swivel elements in each of which one of said transposable and adjustable twisters is mounted, said swivel elements being hingedly connected to said first twister.

2. A device according to claim 1, characterized in that said swivel elements are provided with stop faces facing each other and extending toward each other such that upon contact of said stop faces with each other axes of rotation of said twisters form corners of a hypothetical equilateral triangle.

3. A device according to claim 2, characterized in that a thread guide is disposed on each of said swivel elements.

4. A device according to claim 2, characterized in that the swivel elements are provided with walls facing each other and shaped, at least in part, with groove-like recesses and said stop faces in such a way that upon said contact the swivel elements delimit between them a through-conduit for passage of thread.

5. A device according to claim 1, characterized in that the "S"/"Z" twist changeover means include a seat so disposed that a twister unit comprising said three twisters is adapted to be releasably and removably attached to said seat in at least one position each for an "S" twist drive and a "Z" twist drive.

6. A device according to claim 5, in which said two twisters are each provided with at least one coupling member for coupling with a drive mechanism, characterized in that the seat is provided with a space for the drive mechanism, and said coupling members are adapted to be engaged with the drive mechanism in the drive direction for a selected one of "S" twist or "Z" twist.

7. A device according to claim 6, characterized in that the seat is provided with a bearing for attachment to a holder on a texturing machine.

8. A device according to claim 7, characterized by a contact member supported against a frame of said texturing machine, and operable to be engageable with the seat in such a way that said seat, together with any of said twisters contained therein, is moveable via the bearing relative to the drive mechanism and the machine holder, the coupling members being adapted to be engaged with and disengaged from the drive mechanism.

9. A device according to claim 5, characterized by latches (11, 12) and stop-notch elements complementary thereto, which are disposed each on one of said swivel elements and on the seat, such that the swivel elements are adapted to be fixed in selected swiveled positions by latching.

10. A device according to claim 5, characterized by a locking mechanism mounted between the swivel elements and the seat and supported on the seat and acting on the swivel elements to fix a relative position between the seat and the swivel elements.

11. A device according to claim 5, in which the twister unit is provided with a drive whorl for tangential frictional contact with a drive belt, said device being characterized by a mounting for a counter-roller pressing the drive belt against the drive whorl.

12. A device according to claim 11, with a threading mechanism comprising a threading lever that can be swiveled to the yarn texturing center, and a swivelable locking lever lagging behind said threading lever and which, when closed with the threading lever, can be made to engage therewith and be secured thereto, characterized in that the threading and locking levers are each disposed on a respective swivel element, at least the threading level being mounted so that it is able to swivel with respect to the swivel element.

13. A device according to claim 12, characterized by at least one latch and at least one stop-notch element(s) complementary to said latch, said latch and stop-notch element being so disposed on the counter-roller mounting and on the locking lever that the locking lever is adapted to be fixed in set swiveled positions by latching.

* * * * *